US006348890B1

(12) United States Patent
Stephens

(10) Patent No.: US 6,348,890 B1
(45) Date of Patent: Feb. 19, 2002

(54) PHASED ARRAY ANTENNA BEAMFORMER

(75) Inventor: Ronald Regis Stephens, Westlake Village, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/383,819

(22) Filed: Aug. 26, 1999

(51) Int. Cl.[7] ..... H01Q 3/22

(52) U.S. Cl. ..... 342/375

(58) Field of Search ..... 342/368, 369, 342/370, 371, 372, 373, 374, 375, 376, 377

(56) References Cited

U.S. PATENT DOCUMENTS 4,725,844 A * 2/1988 Goodwin et al. ..... 342/374
5,861,845 A 1/1999 Lee et al.
5,999,128 A 12/1999 Stephens et al.

FOREIGN PATENT DOCUMENTS

EP 0 392 416 10/1990

OTHER PUBLICATIONS

George W. Stimson, "Introduction to Airborne Radar," 2nd edition, SciTech Publishing, Mendham, NJ 1998, p 513.
G.K. Gopalakrishnan et al., "Microwave–optical Mixing in LiNbO3 Modulators," *IEEE Transactions on Microwave Theory and Techniques*, vol. 41, No. 12, Dec. 1993.
R. T. Logan, E. Gertel, "Millimeter–wave Photonic Down-converters: Theory and Demonstrations," Proceedings of SPIE Conference on Optical Technology for Microwave Applications VII, San Diego, CA Jul. 9–14, 1995.
English Translation of EP 0 392 416.

* cited by examiner

*Primary Examiner*—Thomas H. Tarcza
*Assistant Examiner*—Fred H Mull
(74) *Attorney, Agent, or Firm*—Ladas & Parry

(57) ABSTRACT

A method and apparatus for phased array antenna beamforming. An incoming electrical wavefront is received by an antenna. Laser light is amplitude modulated to provide a synthesized optical wavefront beam. The synthesized optical wavefront is mixed with the incoming electrical wavefront by optical modulation to provide a resultant optical waveform tilted to a coarse scan angle. The resultant optical waveform is transmitted to a predetermined delay line to provide an electrical output from the predetermined delay line corresponding to a main lobe of the resultant optical waveform.

24 Claims, 9 Drawing Sheets

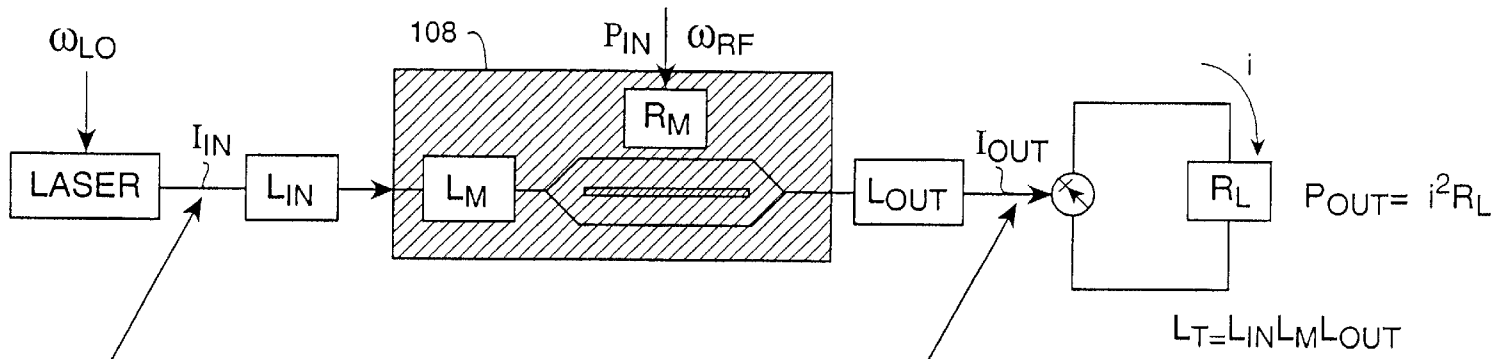

Where:

$$I_{IN} = I_0[1 + M\cos(\omega_{LO}t + \phi)]$$

$$I_{OUT} = \frac{I_{IN}}{2L_T}(1 + m\sin\omega_{RF}t)$$

Photocurrent:

$$i = \frac{rI_0}{2I_T}\{1 + m\sin(\omega_{RF}t) + M\cos(\omega_{LO}t + \phi) \pm \tfrac{1}{2}mM\sin[(\omega_{LO}+\omega_{RF})t + \phi]\}$$

Average RF term LO Mixing (IF) terms

Relative IF Conversion Loss:

$$\frac{P_{OUT}(IF)}{P_{OUT}(RF)} = \left(\frac{\text{IF term}}{\text{RF term}}\right)^2 = \frac{M^2}{4} = -6\text{ dB}$$

Relative to non-converting ink when $M=1$ $(0 \le M \le 1)$

FIG. 9

PHASED ARRAY ANTENNA BEAMFORMER

FIELD OF THE INVENTION

This invention relates to the field of phased array antennas, and, more particularly, to a method and apparatus for antenna beamforming.

BACKGROUND OF THE INVENTION

Phased array antenna systems are widely used in radar, electronic warfare and high data-rate communications applications. A portion of a conventional multibeam phased array antenna system 20 is shown in FIG. 1. The antenna system includes a plurality of radiators 22 that are arranged along an array face 24. The radiator array is typically divided into subarrays. For example, the array might contain 1024 radiators that are divided into four subarrays that each contain 256 radiators. The term radiator is used to refer to both the transmitter and receiver aspect of the antenna system. For simplicity, FIG. 1 illustrates a single 16 element row in one of these subarrays. In each row, each radiator 22 is coupled by a power amplifier 28 to a respective multiplexer 30. Each radiated beam is associated with a different manifold 32 that has a primary transmission line 34 which branches into secondary transmission lines 36 that each couple to a respective one of the multiplexers 30. A programmable delay line 38 is inserted into the primary transmission line 34 and a filter 40 and an adjustable electrical phase shifter 42 are inserted into each secondary transmission line 36. For clarity of illustration, each primary transmission line is labeled with the number of its respective antenna beam.

Operation of the phased array antenna can be separated into coarse and fine beam pointing processes. In a coarse beam pointing process, an appropriate time delay is programmed into each beam #1 delay line of the our subarrays. These time delays generate a selected coarse phase front (e.g., the coarse phase front 44) across the antenna array and, accordingly, a #1 antenna beam is radiated orthogonally to that coarse phase front. In a fine beam pointing process, appropriate phase shifts are selected with the phase shifters 42 that are associated with the manifold of beam #1. These phase shifts modify the coarse phase front to generate a fine phase front (e.g., the fine phase front 46) across the antenna array and, accordingly, the #1 antenna beam is radiated orthogonally to that phase front. This operational process is repeated for each of the other beams, i.e., beams #2, #3 and #4.

However, when data (e.g., pulses) are placed on the radiated signals, the signal spectrum is widened. This can lead to an undesirable increase in beam divergence. This undesirable beam broadening in wide bandwidth signals is commonly referred to as "beam squint". In the antenna 20 of FIG. 1, the delay lines 38 insert an appropriate time delay to form the coarse wavefront 44. Each radiated beam is preferably coarsely steered to a nominal beam angle and then finely steered about this nominal angle. The coarse steering will not induce beam squint but the fine steering will. It can be appreciated, therefore, that it would be advantageous to have phased array structures that generate antenna beams that have low values of beam squint.

One approach which provides for a wideband phased array antenna system that has less beam squint than conventional antennas is set forth in U.S. Pat. No. 5,861,845, entitled "Wideband Phased Array Antennas and Methods" (hereinafter the '845 patent), which is incorporated herein by reference. Such antennas have no beam squint at the selectable scan angles. Although beam squint increases as the scan angle is varied in response to the frequency of the scanning signal, this increase is controlled by increasing the number of reference differential time delays. In contrast to conventional phased-array antennas, antennas of the type set forth in the '845 patent have significantly reduced packaging complexity at the array face and are considered an improvement over conventional phased array antennas.

In reviewing the '845 antenna system in more detail, the antenna system includes an electronic signal generator, reference and scanning manifolds and an array of radiative modules. In transmit mode, the signal generator generates a variable-frequency scanning signal and a reference signal wherein the frequency of the reference signal is substantially a selected one of the sum and the difference of the frequencies of the scanning signal and an operating signal. A reference manifold receives and divides the reference signal into reference signal samples which are progressively time delayed by a selectable one of reference differential time delays. A scanning manifold receives and divides the scanning signal into scanning signal samples which are progressively time delayed by a scanning differential time delay. Each of the radiative modules includes a mixing device, an electromagnetic radiator and a filter. The mixing device receives and mixes a respective one of the reference signal samples and a respective one of the scanning signal samples. The filter couples the mixing device to the radiator and is configured to pass the operating signal. Accordingly, an antenna beam is radiated from the array at selectable scan angles with each of the scan angles varying in response to the frequency of the scanning signal.

In receive mode, operational signals received by the radiators enter mixers and are converted to reference signals with scanning signals that are generated by optical detectors. The converted reference signals are then placed on optical carrier signals in optical signal generators and sent through programmable delay lines. The delayed signals are then detected in optical detectors and combined in a corporate feed to produce a coherent vector sum at a feed output. When receiving incoming operational signals, the delay lines are also programmed as in the transmit operation of the reference manifold. However, in contrast, they are programmed to form conjugate manifolds (e.g., if the manifolds are programmed to generate a transmit beam having a transmit beam angle, they are subsequently programmed to form a receive manifold having a receive beam angle that is the conjugate of the transmit beam angle).

Referring to FIG. 2, a receiver implementation of the invention of the '845 patent is shown. The scanning manifold described in the '845 patent generates the local oscillator wavefront $S_s$. This wavefront is photodetected line-for-line, amplified, then electrically mixed line-for-line with incoming wavefront $S_O$ by subsystem 50 (located at the antenna backplane) to produce an IF wavefront which has a frequency $S_r$. In line switched programmable delay lines 52 then tilt the $S_r$ wavefront to perpendicular propagation 54 and the beam is photodetected and electrically vector summed. The delay lines, photodiodes, and corporate feed correspond to the reference manifold of shown in FIG. 4E of the '845 patent. It should be noted that for this one dimensional (1-D) design, the signal path for the input beam at $S_O$ to the output at $S_r$ undergoes a single electrical to optical to electrical (EOE) conversion. The system of FIG. 2 can be defined as a scan engine and be represented as shown in FIG. 3.

Referring to FIG. 4, a two dimensional (2-D) receiver beamformer design utilizing the teaching of the '845 patent can be accomplished by stacking the FIG. 3 scan engines in orthogonal planes. Each row of the antenna array is vector summed by a scan engine, then the row outputs are vector summed by a single scan engine in the vertical (column) direction. As such, now two EOE conversions are required in the signal path and numerous components are needed at the antenna backplane.

While the phased array antenna system as set forth in the '845 patent provides for a wideband phased array antenna system that has less beam squint than conventional antennas, there still exists, however, a need for not only a wideband phased array antenna system that has less beam squint than conventional antennas, but also one that employs a receiving system that has a less cumbersome implementation, needs minimal EOE conversion steps, and minimizes beamforming components needed at the antenna platform. The present invention as described hereinbelow provides such an antenna system.

SUMMARY OF THE INVENTION

In accordance with the present invention, an incoming electrical wavefront is received by an antenna. Laser light is amplitude modulated to provide a synthesized optical wavefront beam. The synthesized optical wavefront is mixed with the incoming electrical wavefront by optical modulation to provide a resultant optical waveform tilted to a coarse scan angle. The resultant optical waveform is transmitted to a predetermined delay line to provide an electrical output from the predetermined delay line corresponding to a main lobe of the resultant optical waveform.

In another aspect of the invention, a method of multibeam, multi-port phased array antenna beamforming is provided. An incoming electrical wavefront is received by an antenna. A plurality of laser light is amplitude modulated to provide a plurality of synthesized optical wavefront beams. The plurality of synthesized optical wavefronts is mixed with the incoming electrical wavefront by optical modulation to provide a plurality of resultant optical waveforms tilted to respective coarse scan angles. The plurality of resultant optical waveforms are transmitted to predetermined delay lines to provide electrical outputs from the predetermined delay lines corresponding to a main lobe of a respective one of the plurality of resultant optical waveforms.

In a further aspect of the invention, a method of multibeam, multi-port phased array antenna beamforming involving variable frequency is provided. An incoming electrical wavefront is received by an antenna. A plurality of laser light is variable frequency amplitude modulated to provide a plurality of variable frequency synthesized optical wavefront beams. The plurality of variable frequency synthesized optical wavefronts is mixed with the incoming electrical wavefront by optical modulation to provide a plurality of resultant optical waveforms tilted to respective coarse scan angles. The plurality of resultant optical waveforms is transmitted to predetermined delay lines to provide electrical outputs from the predetermined delay lines corresponding to a main lobe of a respective one of the plurality of resultant optical waveforms.

More particularly, in receive mode, the present invention synthesizes a 2-D phase wavefront which is carried to the antenna elements by amplitude modulated laser light within optical fibers. The synthesized wavefront is then mixed with the incoming wavefront by means of optical modulators located at each antenna element. The mixing process results in a fine phase scan which tilts the resultant wavefront to a coarse scan angle. Wavelength division multiplexing (WDM) is used to select the proper delay lines for final summing of the signals at a photodetector or photodetector array. Multiple beam operations also are made possible by WDM, so that both delay line selection and multiple beam separation at the photodetectors is accomplished simply by switching laser wavelengths.

BRIEF DESCRIPTION OF THE DRAWINGS

FIG. 9. shows the process implemented in accordance with one of the photonic downconversion optical modulators of FIG. 7.

DETAILED DESCRIPTION

Figure 5:
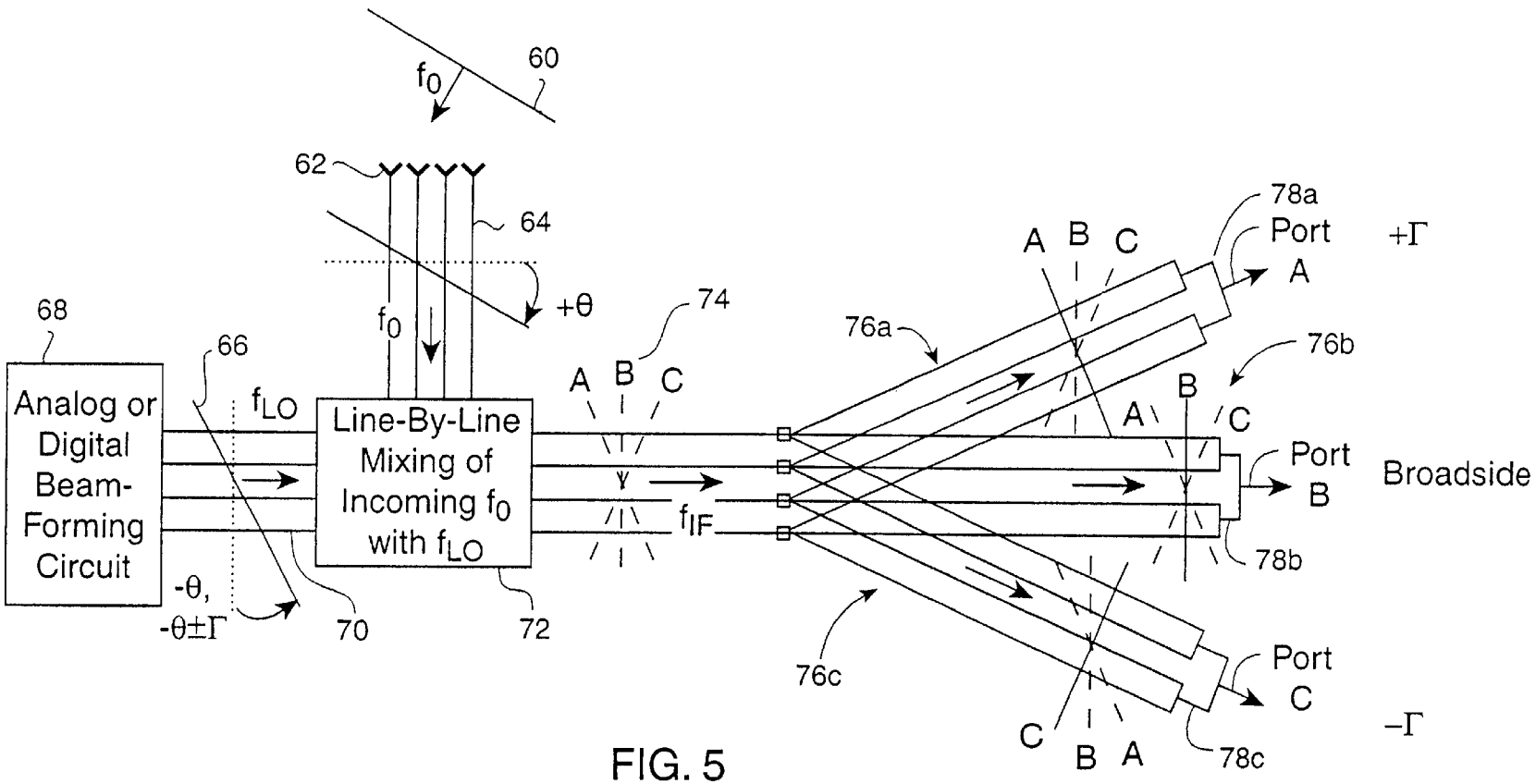
FIG. 5. shows a schematic block diagram overview of an embodiment in accordance with the present invention.

Referring to FIG. 5, a schematic block diagram overview of an embodiment of the present invention is shown. Wavefront 60 at frequency $f_o$ comes in to receive antenna array 62. Wavefront 60 is detected and then it travels down a set of feed lines 64 at a certain angle $\theta$,. i.e. the phase fronts all line up at angle $\theta$.

Analog or digital beamforming circuit 68 generates local oscillator wavefront 66. Local oscillator wavefront 66 is tilted at an angle that is either $-\theta$ if the incoming angle is $+\theta$, or $-\theta+/-\Gamma$ where $\Gamma$ is one angle of the delay lines described below. Local oscillator wavefront 66 travels down feed lines 70.

Wavefront 60 and local oscillator wavefront 66 intersect one another in mixers 72 and there results line by line mixing of the local oscillator wavefront with the incoming wavefront. Such mixing: (1) upconverts or downconverts the $f_o$ frequency to an IF frequency; and (2) tilts the resultant IF wavefront 74 to a selected one of the angles of one of the delay lines.

IF wavefront 74 travels down delay lines 76*a,* 76*b,* 76*c* and will line up with and be perpendicular to the direction of travel for one of the sets of delay lines. There is then an equal line feed 78*a,* 78*b,* 78*c,* at each end which then automatically vector sums whatever comes down the delay line. The one that is perpendicular to the direction of travel will be perfectly vector summed. The output of this delay line will correspond to the peak of the main lobe of received beam 60, and thus will provide the maximum signal, signal to noise ratio, and spurious-free dynamic range.

To reiterate the above processes in more detail, delay lines 76*a,* 76*b,* 76*c* are "Network Switched" delay lines at phase angles ±Γ and broadside (zero). The incoming wavefront at angle θ is mixed line-by-line with LO wavefront 66 to tilt the resulting IF wavefront to the closest delay line angle so that beam squint is minimized. Three possible IF tilt angles are shown which correspond to port phase angles +Γ, broadside, and −Γ, respectively. Assume that port A at phase angle +Γ is chosen. Once the wavefront is in the port A delay line 76*a,* the differential length between lines will tilt wavefront A to be perpendicular to its direction of propagation. The equal length (corporate) summing feed 78*a* at the end will vector sum the line signals into one and the output will correspond to the peak of the beam's main lobe. At ports B and C the wavefront A is not perpendicular to its direction of travel, so the beam is not perfectly summed by corporate feed 78*b,* 78*c* and the output will correspond to a portion of the beam offset in angle from the main lobe and a much lower signal level. Similarly, IF beams tilted to B and C correspondingly vector sum at ports B and C, respectively.

Figure 6:
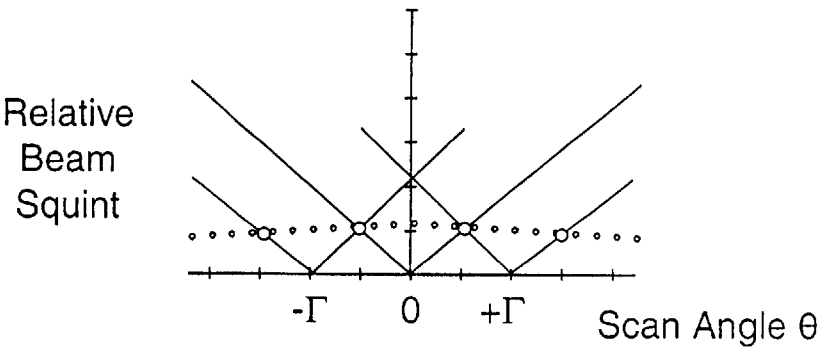
FIG. 6. shows a graph of how beam squint varies with scan angle in accordance with the present invention.
Figure 3:
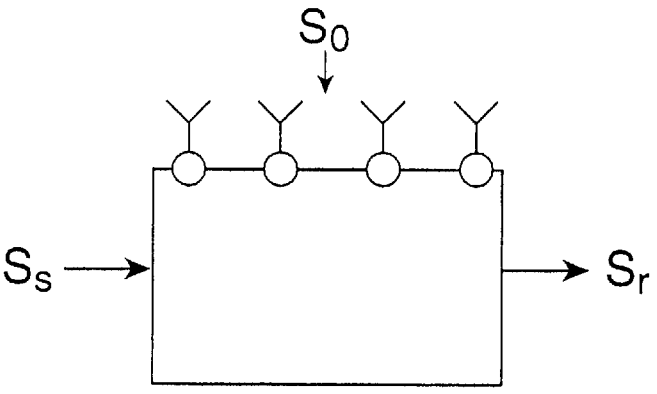
FIG. 3 PRIOR ART
FIG. 3 shows a schematic depiction of a prior art scan engine.
Figure 4:
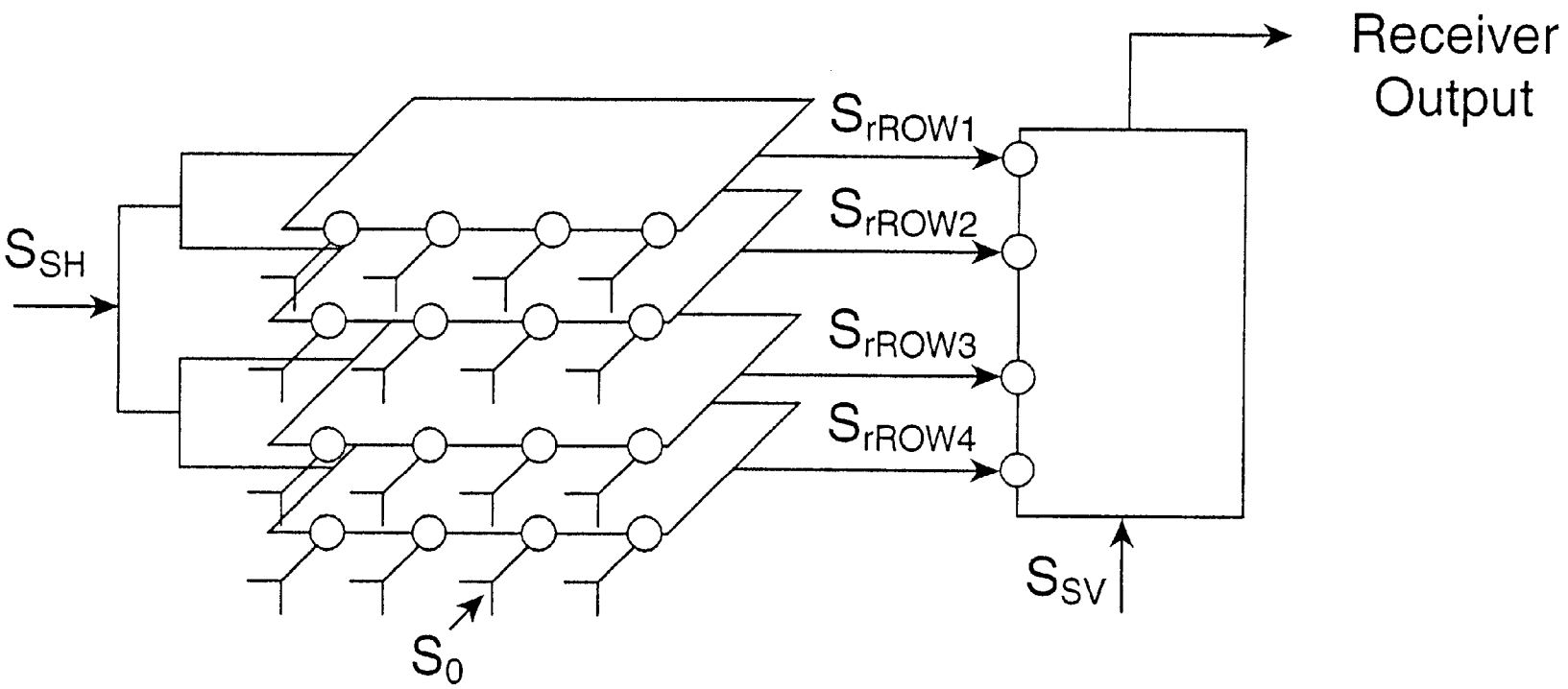
FIG. 4 PRIOR ART
FIG. 4 shows a schematic depiction of a prior art two dimensional receiver beamformer design.

The resulting beam squint is the same as the theory shown in the '845 patent. FIG. 6 shows how the squint varies with scan angle, being zero when the scan angle equals the Port angle (no fine scan required) and increasing as you move away from the Port angle (more fine scan required).

The system of FIG. 5 utilizes "Network Switched" delay lines, where the entire array of signal lines are switched into and out of the circuit, in order to better show how tilting the IF wavefronts results in summing the beam at the various delay line ports. An example of such a network is the Rotman lens and the fiber Rotman lens referred to in the '845 patent. Alternatively, "In-Line Switched" delay lines may also be used to perform the same function. An example of this type would be a binary fiber optic delay line as described by George W. Stimson "Introduction to Airborne Radar", 2nd Edition, SciTech Publishing, Mendham N.J., 1998, p 513. In this latter case proper selection of the in-line switches provides a differential length or time delay between each line to tilt the wavefront to be perpendicular to the direction of travel in a single set of lines. The corporate feed then gives a perfect vector sum and a beam output centered on the main lobe. Both of these delay line types were discussed in the '845 patent.

Figure 1:
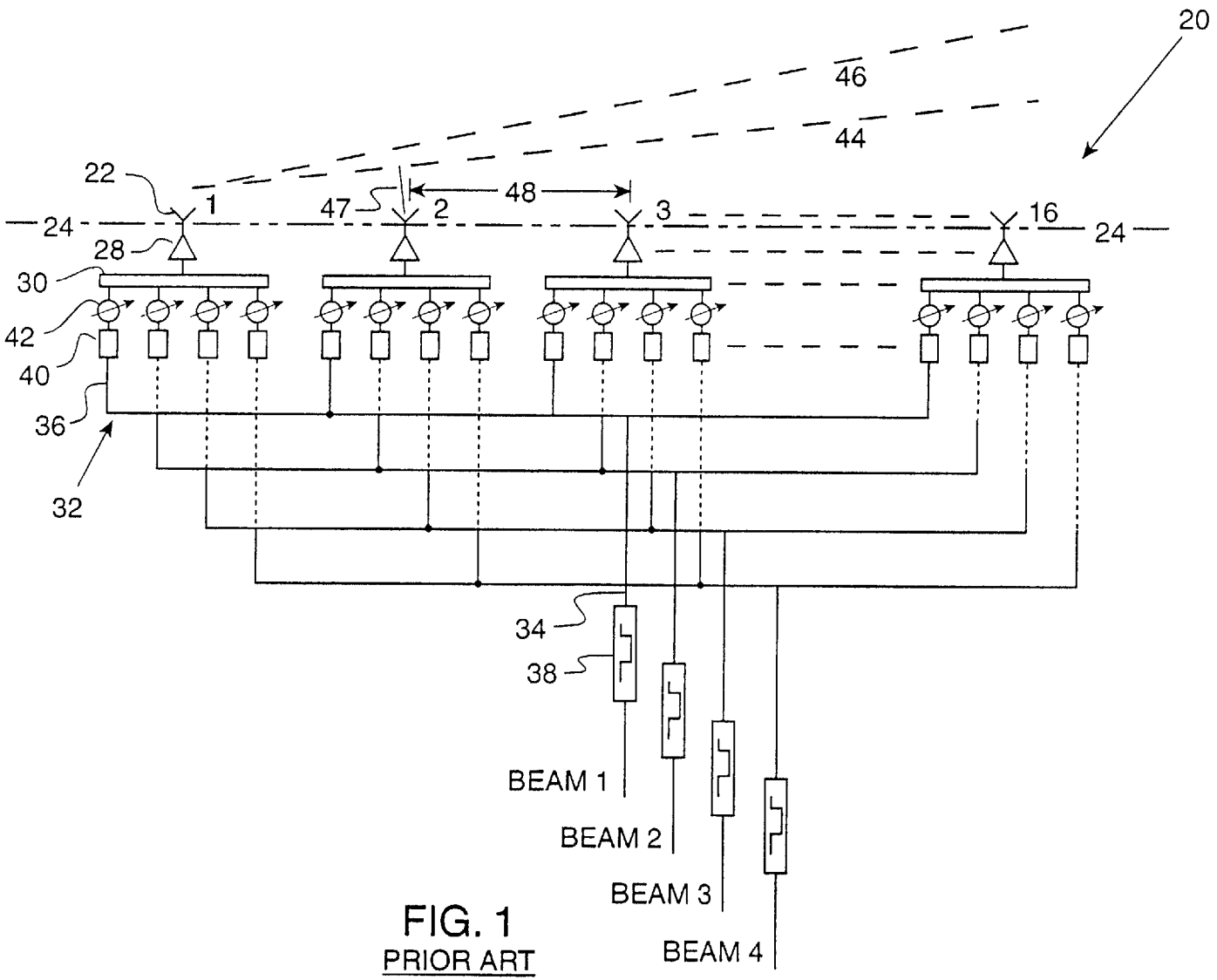
FIG. 1 PRIOR ART
FIG. 1 shows a portion of a prior art multibeam phased array antenna system.
Figure 2:
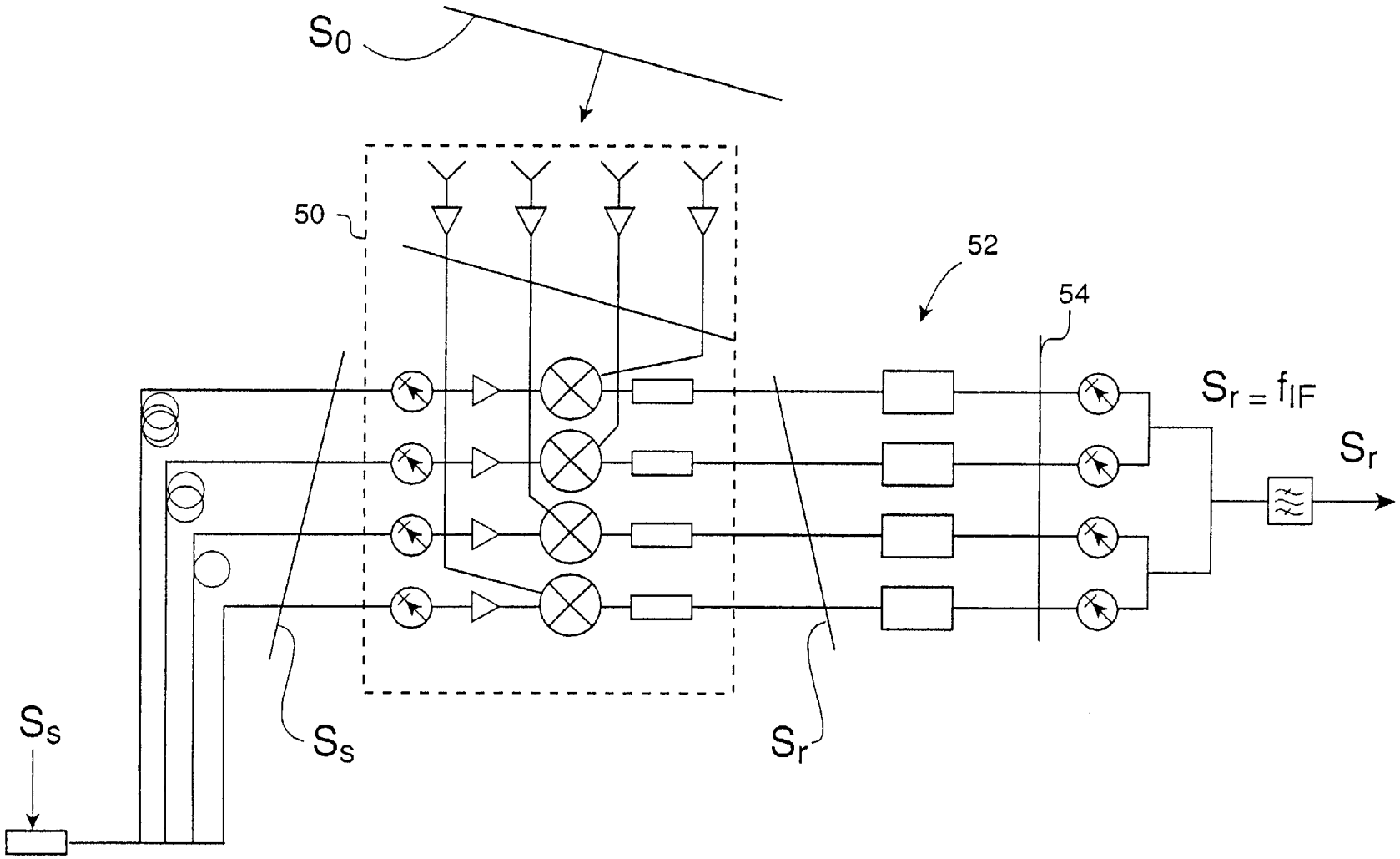
FIG. 2 PRIOR ART
FIG. 2 shows a prior art receiver implementation of a portion of a prior art multibeam phased array antenna system.
Figure 7:
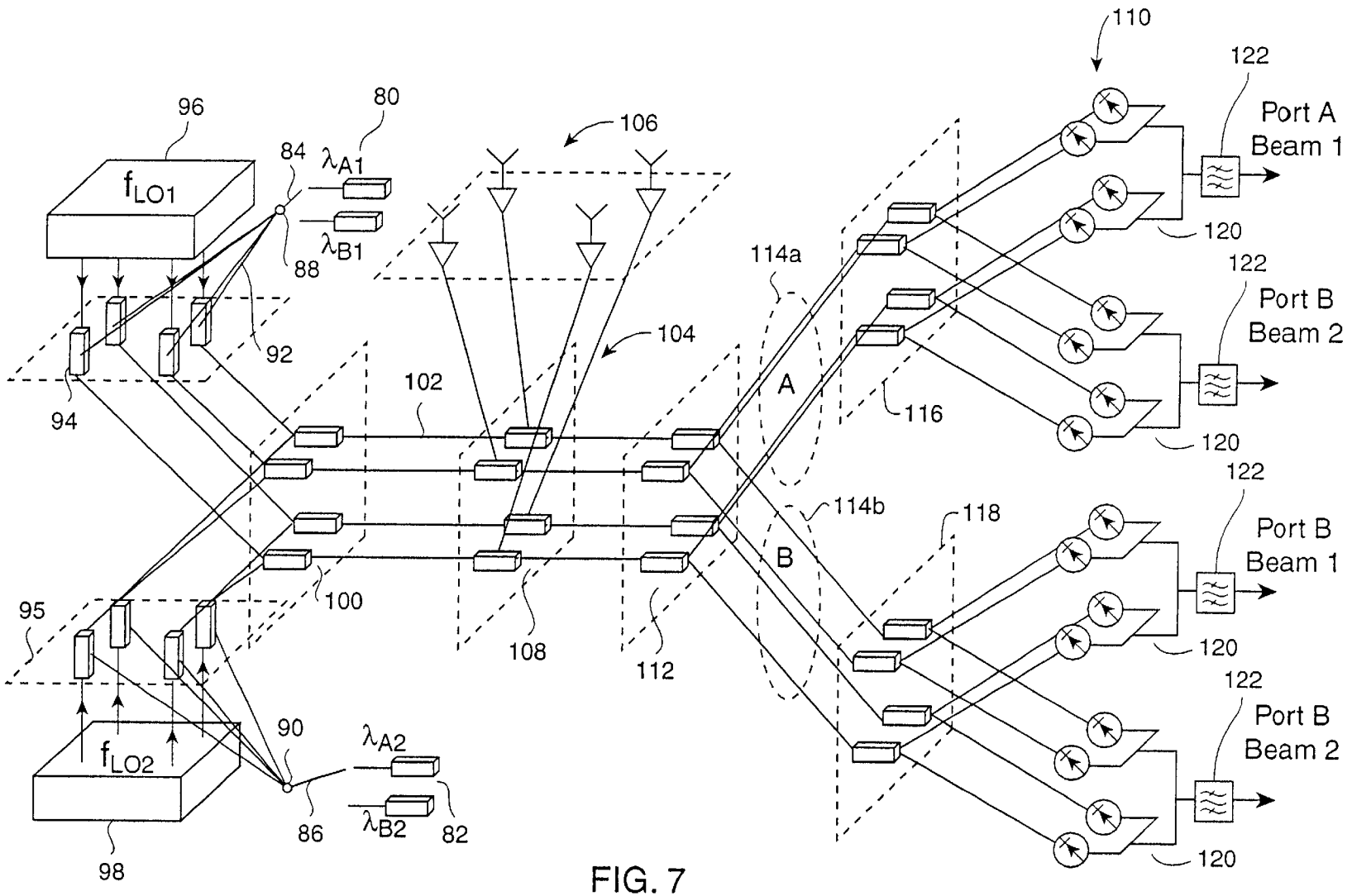
FIG. 7. shows a two dimension, two beam, four line, two port system for a 2×2 phased array antenna system embodiment of the present invention, FIG. 8. shows one of the corresponding individual fiber paths of FIG. 7 from input to output.
Figure 8:
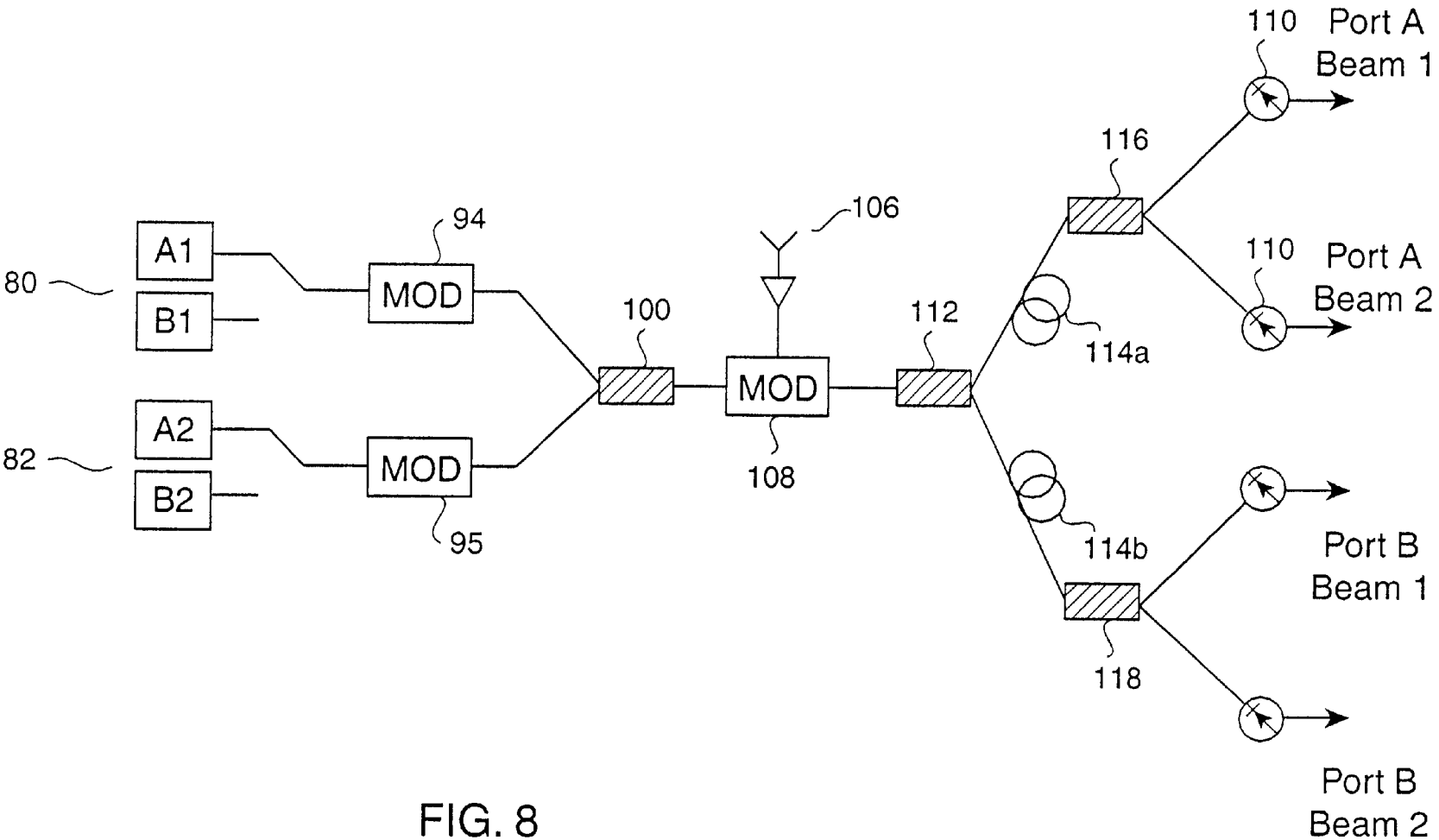

Referring collectively to FIGS. 7 and 8, there is shown in FIG. 7*a* 2-D, 2-beam, 4-line, 2-port system for a 2×2 phased array antenna system embodiment of the present invention, while in FIG. 8 there is depicted one of the corresponding individual fiber paths from input to output of FIG. 7.

In FIG. 7, the 2-D array nature of the component arrangements is emphasized by the dashed parallelograms. Beam 1 lasers 80 at wavelengths λA1 and λB1 and beam 2 lasers 82 at wavelengths λA2 and λB2, for example, Panasonic 50 mW, 1550 nm model LNFE03YB lasers, are enabled depending upon which delay lines (delay Port A or delay Port B) are to be used. The lasers can be switched by optical switches 84, 86, such as JDS Fitel opto-mechanical switch type SW1:N, or, alternatively, connected to a common fiber line by 2×1 optical couplers and then electrically turned on and off. Whichever laser is on for each beam is then split by a 1×4 optical splitter 88, 90, for example, Canadian Instrumentation and Research Limited type 904P couplers, with each fiber 92, for example, Fujikura type SM-15-P-8/125-UV/UV-400 PM fiber, then passing to electro-optic modulators 94, 95 for example, Uniphase Telecommunications Products, Mach-Zehnder modulator type MZ-150-180-T-1-1-B modulators for 1550 nm operation at up to 18 GHz. Phased local oscillators 96, 98 apply via amplitude (intensity) modulation a respective phased local oscillator signal at $f_{LO1}$ and $f_{LO2}$. Any analog or digital means may be used to generate these phased signals which form the LO wavefronts for beams 1 and 2. FIG. 7 assumes that a single laser for each beam and port is externally modulated. Those skilled in the art can appreciate that another way, among others, of generating intensity modulated light is by direct modulation of the diode laser. In such a case, the phased LO signals would be applied directly to lasers located where the LO modulators are situated. All fibers are single mode polarization maintaining (PM) type. The fibers from each beam are combined together by 1×2 PM optical combiners/couplers 100, for example, Canadian Instrumentation and Research Limited type 904P couplers. The resultant single 2×2 array of fibers 102 with LO wavefronts for beams 1 and 2 then passes to an array of modulators 104 which receive signals from antenna array 106.

At modulator array 104 optical modulators 108, for example, Uniphase Telecommunications Products, Mach-Zehnder modulator type MZ-150-180-T-1-1-B LO modulators for 1550 nm operation at up to 18 GHz multiplies line by line the LO wavefront signal in each fiber by the incoming signal from each antenna element 106. The antenna signal is applied to the electrical port of the optical modulator, and the optical LO signal is applied to the fiber input. The multiplication process is equivalent to mixing, and produces sum and difference products. The mixing is accomplished at each antenna element by using the incoming wave at frequency $f_0$ to amplitude modulate the phase-bearing LO signal in each optical modulator. The modulation process multiplies the signals to give two mixing products. The phase of the LO is either added to or subtracted from the incoming wavefront phase. Here the phases differ for each antenna element, and the linear phase variation from element to element is what determines the wavefront angle. The resultant IF frequency wavefront at $f_{IF}=f_0 \pm f_{LO}$ can be tilted to any angle. The sum frequencies are usually filtered out downstream by photodetectors 110 and filters 122 so that only a frequency down-conversion takes place.

This optical/microwave mixing process is commonly referred to as "photonic down-conversion" and is discussed in detail in various papers on photonic down-conversion, such as: (1) G. K. Gopalakrishnan, W. K. Bums, and C. H. Bulmer, "Microwave-optical mixing in $LiNbO_3$ modulators," IEEE Transactions on Microwave Theory and Techniques, Vol. 41, NO. 12, December 1993. (2) R. T. Logan and E. Gertel, "Millimeter-wave photonic downconverters: Theory and demonstrations," Proceedings of SPIE Conference on Optical Technology for Microwave Applications VII, San Diego, Calif., Jul. 9–14, 1995. FIG. 9 of the present application depicts the process implemented in accordance with one of the photonic downconversion optical modulators 108 of FIG. 7 of the present application. The main result of applying this conversion is that for a modulation index of M=1, the insertion loss of the down-converting fiber link representing this process is only 6 dB worse than that of the same photonic link without the down-conversion. If a signal were down-converted in the electrical domain after photodetection, it would typically undergo a loss of at least 6 dB per down-conversion step. Therefore, including down-conversion as part of the optical process can be as efficient as the equivalent electrical process but will reduce parts count at the antenna. Very often more than one down-conversion step is needed when this is done in the electrical domain, whereas if done optically the down-conversion can be done in one step. So the overall loss for the photonic approach can be less.

Referring back to FIG. 7, after passing through down-conversion modulators 108, the signals are directed to the proper set of delay lines by port selection wavelength division multiplexers (WDMs) 112. These port selection WDMs have output passbands λA1+λA2 and λB1+λB2 for the respective ports A and B. After passing through delay lines 114*a,* 114*b* and having their respective IF wavefronts tilted perpendicular to the direction of propagation, the signals encounter the beam selection WDMs 116 and beam selection WDMs 118. WDMs 116 have output passbands λA1+λA2. WDMs 118 have output passbands λB1+λB2. This arrangement of port and beam selection WDMs directs the beam signals through the proper delay lines and to the correct set of photodetectors 110 simply by switching laser 80, 82 at the system input. After routing to the proper location, the respective beams are photodetected by photodetectors 110 and then summed electrically in equal-length corporate feeds 120. Filtering is then performed by filters 122 to remove the unwanted mixing product (usually removing the sum $f_o+f_{LO}$). Examples of WDMs include Photonics Integration Research Inc. type AWG (with various selectable wavelength ranges and spacings).

All of the fiber and electrical lines shown in FIG. 7 would have the same length except for the actual delay lines at A and B. This is necessary to preserve the relative microwave phases of the LO, RF antenna input, and down-converted IF signals as they pass through the system. Only in the delay lines do the lengths between one line and another differ, and these differences, ΔL, are determined by:

$$\Delta L = \frac{\Delta x v}{c}\sin\theta_{coarse}$$

where

Δx is antenna element spacing v is velocity of light in optical fibers c is velocity of light in vacuum $\theta_{coarse}$ is the coarse scan angle.

This is independent of $f_{LO}$ and microwave wavelength.

Also, it should be noted that in the signal path after down-conversion modulators 108, the optical fiber need not be PM any more (it was PM because the modulators need input of a given polarization which must be maintained as the light travels down the fibers). It can be regular single mode fiber, for example, Corning model SMF-28 fiber.

Further, it should be also noted that the insertion loss of a 1×N WDM is less than a 1×N splitter/coupler for N≧6 for current technology. Thus, if the system has a small number of beams or ports, i.e. N≦6, lower overall system loss can be achieved by replacing the WDMs in FIG. 7 by splitter/combiners. This may also simplify the wavelength ranges by reducing the number of wavelengths needed to pass a signal successfully through the system. An embodiment of the present invention has its greatest utility when the number of ports or beams is ≧6 with current WDM technology.

Figure 10:
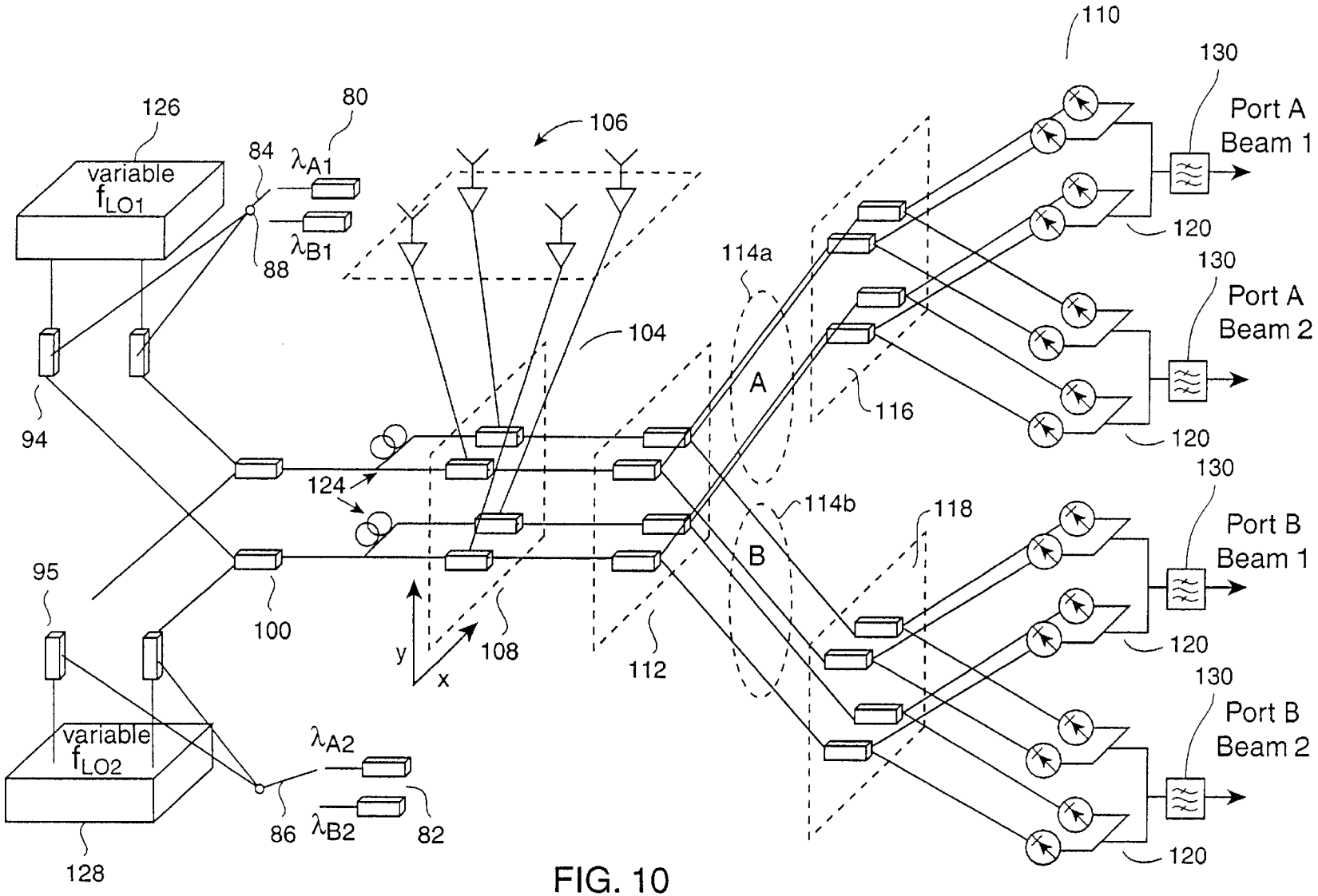
FIG. 10. shows an alternative two dimension, two beam, four line, two port system for a 2×2 phased array antenna system embodiment of the present invention.

Referring to FIG. 10, there is an alternative embodiment, similar to that depicted in FIG. 7, where similar components are similarly numbered. However, The number of LO modulators and optical combiners can be reduced significantly if a variable LO frequency approach is followed. Delay lines 124 are inserted in the x-direction between down-conversion modulators 108 which allows a 2-D LO wavefront to be formed using only a 1-D LO phased signal generator. For an N×N antenna array this reduces the number of LO modulators (and optical combiners) from $N^2$ to N which can be a significant cost reduction. However, one-dimensional variable LO frequency $f_{LO1}$ generator 126 and one-dimensional variable LO frequency $f_{LO2}$ generator 128, replace the counterpart 2-D LO generators 96, 98 of FIG. 7. In addition, dynamic (tunable) filters 130 after photodetection replace filters 122 of FIG. 7, to track the resultant variable $f_{IF}$. This embodiment would be a preferred embodiment for very large arrays. In this embodiment, the y (vertical) phase differences between fibers, $\Delta\phi_y$, are produced by the 1-D, phased, variable $f_{LO}$ generators 126, 128 similar to what was done in 2-D for the embodiment of FIG. 7. That is, each modulator of set 94 or set 95 receives the same $f_{LO1}$ or $f_{LO2}$ but with a phase difference $\Delta\phi_{y1}$ or $\Delta\phi_{y2}$ between modulators. However, in this embodiment the required x (horizontal) phase differences $\Delta\phi_x$ are produced by varying $f_{LO}$ and then passing these signals through delay lines 124. The x phase difference will vary as $\Delta=2\pi f_{LO}\delta l_x/v$ where $\delta l_x$ is the length of delay lines 124 and v is the velocity of light in optical fiber. Varying $f_{LO}$ thus varies $\Delta\phi_x$, and the change in $f_{LO}$ required to produce a given $\Delta\phi_x$ can be made smaller by increasing $\delta l_x$. The antenna is easily scanned in 2-D using phased $f_{LO}$ generators 126, 128. First, the scan in the x direction is set by tuning a generator to an $f_{LO}$ needed to give the desired $\Delta\phi_x$. Then, at this fixed $f_{LO}$, the generator adjusts the $\Delta\phi_y$ to give the desired scan angle in the y direction.

There are practical limitations as to how large $\delta l_x$ can be. As $\delta l_x$ becomes larger, requirements on the frequency stability of $f_{LO}$ become more stringent if the fluctuations in scan angle are to be kept to tolerable levels. Thus, $\delta l_x$ can be chosen only so large that the stability of system components, such as $f_{LO}$ frequency synthesizers 126, 128 and any system beam control circuitry do not produce excessive beam scan angle fluctuations. Thus, there will always need to be some variation in $f_{IF}$ as the beam is scanned in the x direction. However, the variations in $f_{IF}$ may be easily compensated for by the use of dynamic (tunable) filters 130. Also, if a fixed IF is desired, a second down-conversion step to $f_{IF2}$ may be added after filters 130. In this case, a second LO, at frequency $f_{LO2}=f_{IF}-f_{IF2}=f_0-f_{LO}-f_{IF2}$, would be varied in concert with $f_{LO}$ to produce the fixed $f_{IF2}$.

Therefore, in accordance with present invention a method and apparatus is provided which greatly simplifies an antenna system backplane when operated in the receive mode since it then requires no processing in the RF domain at the antenna. In receive mode, only two beamformer components—an optical modulator and a fiber delay line—are located at each antenna element. These components are low-weight, compact devices that consume low or no power. The rest of the system can be located remotely where power and cooling requirements are more easily accommodated. The mechanical and thermal design of both the antenna array and the remote facility are greatly simplified by an implementation of the present invention. Further, the present invention uses only a single electrical to optical to electrical (EOE) photonic conversion step in the information signal path for 2-D implementations. Previous 2-D wideband photonic beamformers required two photonic conversion steps because they employed 1-D scan engines stacked in orthogonal planes, such as that used in the '845 patent. The requirement of only a single EOE conversion step typically will result in a >30 dB improvement in system insertion loss and noise figure, and a 5 to 20 dB improvement in spurious free dynamic range compared to the architecture taught in the '845 patent.

What is claimed is:

1. A method of phased array antenna beamforming comprising the steps of:

receiving an incoming electrical wavefront by an antenna;

amplitude modulating laser light to provide a synthesized optical wavefront beam;

mixing the synthesized optical wavefront with the incoming electrical wavefront by optical modulation to provide a resultant optical waveform tilted to a coarse scan angle; and transmitting the resultant optical waveform to a predetermined delay line to provide an electrical output from the predetermined delay line corresponding to a main lobe of the resultant optical waveform.

2. The method of phased array antenna beamforming of claim 1, wherein the step of amplitude modulating laser light includes the steps of:

providing an optical laser beam; and amplitude modulating the optical laser beam to provide the synthesized optical wavefront beam as a local oscillator signal.

3. The method of phased array antenna beamforming of claim 2, wherein the step of mixing the synthesized optical wavefront with the incoming electrical wavefront includes the step of multiplying the local oscillator signal with the incoming electrical wavefront to provide a resultant optical waveform having a mixing product difference wherein a phase of the local oscillator signal is subtracted from a phase of the incoming electrical wavefront to form the resultant optical waveform tilted to a coarse scan angle.

4. The method of phased array antenna beamforming of claim 3, wherein the step of transmitting the resultant optical waveform to a predetermined delay line includes the steps of:

selecting the predetermined delay line coupled to an output port by wavelength division multiplexing to enable the resultant optical waveform to be tilted perpendicular to a direction of propagation; and photodetecting the resultant optical waveform.

5. A method of multi-beam, multi-port phased array antenna beamforming comprising the steps of:

receiving an incoming electrical wavefront by an antenna;

amplitude modulating a plurality of laser light to provide a plurality of synthesized optical wavefront beams;

mixing selected ones of the plurality of synthesized optical wavefronts with the incoming electrical wavefront by optical modulation to provide a selected resultant optical waveform tilted to respective coarse scan angles; and transmitting a selected resultant optical waveform to a selected predetermined delay line to provide an electrical output from the selected predetermined delay line to a selected one of a plurality of ports corresponding to a main lobe of the selected one of the plurality of resultant optical waveforms.

6. The method of multi-beam, multi-port phased array antenna beamforming of claim 5, wherein the step of amplitude modulating a plurality of laser light includes the steps of:

providing a plurality of optical laser beams; and amplitude modulating the optical laser beams to provide the synthesized optical wavefront beams as local oscillator signals.

7. The method of multi-beam, multi-port phased array antenna beamforming of claim 6, wherein the step of mixing the plurality of synthesized optical wavefronts with the incoming electrical wavefront includes the step of multiplying the local oscillator signals with the incoming electrical wavefront to provide resultant optical waveforms having mixing product differences wherein a phase of the local oscillator signals are subtracted from a phase of the incoming electrical wavefront to form a plurality of resultant optical waveforms tilted to respective coarse scan angles.

8. The method of multi-beam, multi-port phased array antenna beamforming of claim 7, wherein the step of transmitting the resultant optical waveforms to predetermined delay lines by wavelength division multiplexing to provide electrical outputs includes the steps of:

selecting the predetermined delay line coupled to an output port by wavelength division multiplexing to enable the resultant optical waveforms to be tilted perpendicular to a direction of propagation; and photodetecting the resultant optical waveforms.

9. A method of multi-beam, multi-port phased array antenna beamforming comprising the steps of:

receiving an incoming electrical wavefront by an antenna;

variable frequency amplitude modulating a plurality of laser light to provide a plurality of variable frequency synthesized optical wavefront beams;

mixing selected ones of the plurality of variable frequency synthesized optical wavefronts with the incoming electrical wavefront by optical modulation to a selected resultant optical waveform tilted to respective coarse scan angles; and transmitting the selected resultant optical waveform to selected predetermined delay lines to provide electrical outputs from the selected predetermined delay lines to a selected one of a plurality of output ports corresponding to a main lobe of the selected one of the plurality of resultant optical waveforms.

10. The method of multi-beam, multi-port phased array antenna beamforming of claim 9, wherein the step of variable frequency amplitude modulating a plurality of laser light includes the steps of:

providing a plurality of optical laser beams; and variable frequency amplitude modulating the optical laser beams to provide the synthesized optical wavefront beams as local oscillator signals.

11. The method of multi-beam, multi-port phased array antenna beamforming of claim 10, wherein the step of mixing the plurality of variable frequency synthesized optical wavefronts with the incoming electrical wavefront includes the steps of:

delaying first variable frequency local oscillator signals with respect to second variable frequency local oscillator signals; and the multiplying each of the variable frequency local oscillator signals with the incoming electrical wavefront to provide resultant optical waveforms having mixing product differences wherein a phase of the local oscillator signals are subtracted from a phase of the incoming electrical wavefront to form a plurality of resultant optical waveforms tilted to respective coarse scan angles.

12. The method of multi-beam, multi-port phased array antenna beamforming of claim 11, wherein the step of transmitting the resultant optical waveforms to predetermined delay lines by wavelength division multiplexing to provide electrical outputs includes the steps of:

selecting the predetermined delay line coupled to an output port by wavelength division multiplexing to enable the resultant optical waveforms to be tilted perpendicular to a direction of propagation;

photodetecting the resultant optical waveforms; and tunable filtering photodetected signals to track resultant variable frequency electrical output.

13. A phased array antenna beamformer comprising:

an antenna for receiving an incoming electrical wavefront;

an amplitude modulating laser light source for providing a synthesized optical wavefront beam;

an optical modulator coupled to the antenna and to the amplitude modulating laser light source to mix the synthesized optical wavefront with the incoming electrical wavefront to provide a resultant optical waveform tilted to a coarse scan angle; and one or more delay lines coupled to the optical modulator and having means to select a predetermined delay line for transmitting the resultant optical waveform to the predetermined delay line to provide a vector sum electrical output from the predetermined delay line corresponding to a main lobe of the resultant optical waveform.

14. The phased array antenna beamforming of claim 13, wherein the amplitude modulating laser light source includes:

an optical laser beam source; and an amplitude modulator responsive to an optical laser beam from the optical laser beam source for providing the synthesized optical wavefront beam as a local oscillator signal.

15. The phased array antenna beamformer of claim 14, wherein the optical modulator multiplies the local oscillator signal with the incoming electrical wavefront to provide a resultant optical waveform having a mixing product difference which has a phase of the local oscillator signal subtracted from a phase of the incoming electrical wavefront to form the resultant optical waveform tilted to a coarse scan angle.

16. The phased array antenna beamformer of claim 15, wherein the delay lines include:

a wavelength division mutliplexer for selecting the predetermined delay line coupled to an output port to enable the resultant optical waveform to be tilted perpendicular to a direction of propagation; and a photodetector coupled to each of the delay lines to detect the resultant optical waveform and provide an electrical output signal from the output port representative of the resultant optical waveform.

17. A multi-beam, multi-port phased array antenna beamformer comprising:

an antenna for receiving an incoming electrical wavefront;

a plurality of amplitude modulating laser light sources for providing a plurality of synthesized optical wavefront beams;

an optical modulator coupled to the antenna and to the plurality of amplitude modulating laser light sources to mix selected ones of the plurality of synthesized optical wavefronts with the incoming electrical wavefront by optical modulation to provide a selected resultant optical waveform tilted to respective coarse scan angles; and one or more delay lines coupled between the optical modulator and a plurality of output ports and having means to select a predetermined delay line for transmitting a selected resultant optical waveform to provide an electrical output to a selected one of the plurality of output ports from the selected predetermined delay line corresponding to a main lobe of the selected one of the plurality of resultant optical waveforms.

18. The multi-beam, multi-port phased array antenna beamformer of claim 17, wherein the plurality of amplitude modulating laser light sources includes:

a plurality of optical laser beam sources; and a switch for coupling a selected one of the plurality of optical laser beam sources to an amplitude modulator; the amplitude modulator providing a selected synthesized optical wavefront beam as a selected local oscillator signal.

19. The multi-beam, multi-port phased array antenna beamformer of claim 18 wherein the optical modulator multiples the selected one of the plurality of synthesized optical wavefronts with the incoming electrical wavefront to provide a resultant optical waveform having a mixing product difference which has a phase of the selected local oscillator signal subtracted from a phase of the incoming electrical wavefront to form the resultant optical waveform tilted to a coarse scan angle.

20. The multi-beam, multi-port phased array antenna beamformer of claim 19, wherein the delay lines include:

a wavelength division multiplexer for selecting the predetermined delay line coupled to a selected output port to enable the selected resultant optical waveform to be tilted perpendicular to a direction of propagation; and a photodetector coupled to each of the delay lines to detect the selected resultant optical waveform and provide an electrical output signal representative of the resultant optical waveform to the selected output port.

21. A multi-beam, multi-port phased array antenna beamformer comprising:

an antenna for receiving an incoming electrical wavefront;

a plurality of variable frequency amplitude modulating laser light sources for providing a plurality of variable frequency synthesized optical wavefront beams;

an optical modulator coupled to the antenna and to the plurality of variable frequency amplitude modulating laser light sources to mix selected ones of the plurality of variable frequency synthesized optical wavefronts with the incoming electrical wavefront by optical modulation to provide a selected resultant optical waveform tilted to respective coarse scan angles; and one or more delay lines coupled between the optical modulator and a plurality of output ports and having means to select a predetermined delay line for transmitting a selected resultant optical waveform to provide an electrical output to a selected one of the plurality of output ports from the selected predetermined delay line corresponding to a main lobe of the selected one of the plurality of resultant optical waveforms.

22. The multi-beam, multi-port phased array antenna beamformer of claim 21, wherein the plurality of variable frequency amplitude modulating laser light sources includes:

a plurality of optical laser beam sources; and a switch for coupling a selected one of the plurality of optical laser beam sources to a variable frequency amplitude modulator, the variable frequency amplitude modulator providing a selected synthesized optical wavefront beam as a selected local oscillator signal.

23. The multi-beam, multi-port phased array antenna beamformer of claim 22, further including a first delay line and a second delay line for delaying first variable frequency local oscillator signals with respect to second variable frequency local oscillator signals, and wherein the optical modulator multiples the selected one of the plurality of variable frequency synthesized optical wavefronts with the incoming electrical wavefront to provide a resultant optical waveform having a mixing product difference which has a phase of the selected local oscillator signal subtracted from a phase of the incoming electrical wavefront to form the resultant optical waveform tilted to a coarse scan angle.

24. The multi-beam, multi-port phased array antenna beamformer of claim 23, wherein the delay lines include:

a wavelength division multiplexer for selecting the predetermined delay line coupled to a selected output port to enable the selected resultant optical waveform to be tilted perpendicular to a direction of propagation;

a photodetector coupled to each of the delay lines to detect the selected resultant optical waveform and provide an electrical output signal representative of the resultant optical waveform to the selected output port; and a tunable electrical filter coupled to each of the photodetectors to filter photodetected signals to track resultant variable frequency electrical output.

* * * * *